US008682237B2

(12) United States Patent
Ishigaya et al.

(10) Patent No.: US 8,682,237 B2
(45) Date of Patent: Mar. 25, 2014

(54) FIXING DEVICE AND IMAGE FORMING APPARATUS INCLUDING SAME

(71) Applicants: Yasunori Ishigaya, Kanagawa (JP); Akira Shinshi, Tokyo (JP); Kenichi Hasegawa, Kanagawa (JP); Hiroshi Yoshinaga, Chiba (JP); Ryota Yamashina, Kanagawa (JP)

(72) Inventors: Yasunori Ishigaya, Kanagawa (JP); Akira Shinshi, Tokyo (JP); Kenichi Hasegawa, Kanagawa (JP); Hiroshi Yoshinaga, Chiba (JP); Ryota Yamashina, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/022,627

(22) Filed: Sep. 10, 2013

(65) Prior Publication Data

US 2014/0010578 A1 Jan. 9, 2014

Related U.S. Application Data

(63) Continuation of application No. 12/929,325, filed on Jan. 14, 2011, now Pat. No. 8,559,860.

(30) Foreign Application Priority Data

Jan. 26, 2010 (JP) ..... 2010-013963

(51) Int. Cl.
*G03G 15/20* (2006.01)

(52) U.S. Cl.
USPC ..... 399/329

(58) Field of Classification Search
USPC ..... 399/328, 329, 334
See application file for complete search history.

(56) References Cited

U.S. PATENT DOCUMENTS

| | | | |
|---|---|---|---|
| 6,131,009 | A | 10/2000 | Hasegawa |
| 6,496,666 | B2 | 12/2002 | Hayashi et al. |
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |

(Continued)

FOREIGN PATENT DOCUMENTS

| | | | |
|---|---|---|---|
| CN | 101000484 | A | 7/2007 |
| CN | 101192040 | A | 6/2008 |

(Continued)

OTHER PUBLICATIONS

Abstract of JP 04-044075 published on Feb. 13, 1992.

(Continued)

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

A fixing device includes a fixing member, a pressing member, a stationary member, a metal member, flanges, a first heater, and a second heater. The pressing member is rotatably pressed against an outer circumferential surface of the fixing member to form a nip therebetween. The metal member is fixedly disposed opposite an inner circumferential surface of the fixing member over an area other than the nip. The flanges are disposed at axial edges of the metal member in contact with an inner circumferential surface of the metal member. The first heater is disposed opposite the inner circumferential surface of the metal member to heat an axial middle portion of the metal member. The second heater is disposed opposite the inner circumferential surface of the metal member to heat axial end portions of the metal member. The first heater is disposed farther from the nip than the second heater.

3 Claims, 5 Drawing Sheets

(56) References Cited

U.S. PATENT DOCUMENTS

| | | | |
|---|---|---|---|
| 6,785,505 | B2 | 8/2004 | Yasui et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 7,022,944 | B2 | 4/2006 | Yoshinaga et al. |
| 7,070,182 | B2 | 7/2006 | Hasegawa |
| 7,127,204 | B2 | 10/2006 | Satoh et al. |
| 7,151,907 | B2 | 12/2006 | Yoshinaga |
| 7,239,838 | B2 | 7/2007 | Sato et al. |
| 7,242,897 | B2 | 7/2007 | Satoh et al. |
| 7,313,353 | B2 | 12/2007 | Satoh et al. |
| 7,330,682 | B2 | 2/2008 | Shinshi |
| 7,379,698 | B2 | 5/2008 | Yoshinaga |
| 7,454,151 | B2 | 11/2008 | Satoh et al. |
| 7,509,085 | B2 | 3/2009 | Yoshinaga et al. |
| 7,515,850 | B2 | 4/2009 | Hasegawa |
| 7,546,049 | B2 | 6/2009 | Ehara et al. |
| 7,574,153 | B2 | 8/2009 | Nakayama et al. |
| 7,593,680 | B2 | 9/2009 | Shinshi |
| 7,630,652 | B2 | 12/2009 | Hasegawa |
| 7,742,714 | B2 | 6/2010 | Shinshi et al. |
| 2002/0009306 | A1 | 1/2002 | Hayashi et al. |
| 2002/0018663 | A1 | 2/2002 | Furukawa et al. |
| 2002/0044805 | A1 | 4/2002 | Hasegawa |
| 2002/0067936 | A1 | 6/2002 | Yasui et al. |
| 2003/0000933 | A1 | 1/2003 | Yoshinaga et al. |
| 2003/0007813 | A1 | 1/2003 | Yasui et al. |
| 2003/0016963 | A1 | 1/2003 | Yoshinaga et al. |
| 2003/0206758 | A1 | 11/2003 | Yasui et al. |
| 2003/0215271 | A1 | 11/2003 | Yoshinaga et al. |
| 2004/0013453 | A1 | 1/2004 | Shinshi et al. |
| 2004/0178573 | A1 | 9/2004 | Hasegawa |
| 2005/0025539 | A1 | 2/2005 | Yoshinaga |
| 2005/0095043 | A1 | 5/2005 | Yoshinaga et al. |
| 2005/0163543 | A1 | 7/2005 | Satoh et al. |
| 2006/0002737 | A1 | 1/2006 | Shinshi |
| 2006/0029411 | A1 | 2/2006 | Ishii et al. |
| 2006/0051120 | A1 | 3/2006 | Kishi et al. |
| 2006/0116230 | A1 | 6/2006 | Satoh et al. |
| 2006/0165429 | A1 | 7/2006 | Satoh et al. |
| 2006/0165443 | A1 | 7/2006 | Yoshinaga et al. |
| 2006/0165448 | A1 | 7/2006 | Yoshinaga |
| 2006/0257183 | A1 | 11/2006 | Ehara et al. |
| 2007/0000334 | A1 | 1/2007 | Bitto et al. |
| 2007/0014600 | A1 | 1/2007 | Ishii et al. |
| 2007/0014603 | A1 | 1/2007 | Satoh et al. |
| 2007/0059003 | A1 | 3/2007 | Shinshi et al. |
| 2007/0059071 | A1 | 3/2007 | Shinshi et al. |
| 2007/0077104 | A1 | 4/2007 | Hasegawa |
| 2007/0110464 | A1 | 5/2007 | Nakayama et al. |
| 2007/0166062 | A1 | 7/2007 | Shimokawa |
| 2007/0166085 | A1 | 7/2007 | Shinshi |
| 2007/0292175 | A1 | 12/2007 | Shinshi |
| 2008/0063443 | A1 | 3/2008 | Yoshinaga et al. |
| 2008/0112739 | A1 | 5/2008 | Shinshi |
| 2008/0175633 | A1 | 7/2008 | Shinshi |
| 2008/0219730 | A1 | 9/2008 | Shinshi |
| 2008/0253788 | A1 | 10/2008 | Shinshi |
| 2008/0253789 | A1 | 10/2008 | Yoshinaga et al. |
| 2008/0298862 | A1 | 12/2008 | Shinshi |
| 2008/0310862 | A1 | 12/2008 | Hasegawa |
| 2008/0317532 | A1 | 12/2008 | Ehara et al. |
| 2009/0067902 | A1 | 3/2009 | Yoshinaga et al. |
| 2009/0123202 | A1 | 5/2009 | Yoshinaga et al. |
| 2009/0148204 | A1 | 6/2009 | Yoshinaga et al. |
| 2009/0169232 | A1 | 7/2009 | Kunii et al. |
| 2009/0245865 | A1 | 10/2009 | Shinshi et al. |
| 2009/0297199 | A1 | 12/2009 | Yamashina et al. |
| 2009/0311016 | A1 | 12/2009 | Shinshi |
| 2010/0061754 | A1 | 3/2010 | Ishigaya et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2011/0026987 | A1 | 2/2011 | Hasegawa |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064443 | A1 | 3/2011 | Iwaya et al. |
| 2011/0070517 | A1 | 3/2011 | Kong et al. |
| 2011/0076071 | A1 | 3/2011 | Yamaguchi et al. |
| 2011/0085832 | A1 | 4/2011 | Hasegawa et al. |
| 2011/0091226 | A1 | 4/2011 | Ishigaya et al. |
| 2011/0116848 | A1 | 5/2011 | Yamaguchi et al. |
| 2011/0129268 | A1 | 6/2011 | Ishii et al. |

FOREIGN PATENT DOCUMENTS

| | | | |
|---|---|---|---|
| JP | 2884714 | A | 2/1992 |
| JP | 07-064437 | A | 3/1995 |
| JP | 3298354 | A | 10/1996 |
| JP | 10213984 | A | 8/1998 |
| JP | 11052771 | A | 2/1999 |
| JP | 2001-201978 | A | 7/2001 |
| JP | 3763815 | A | 7/2004 |
| JP | 2006-162672 | A | 6/2006 |
| JP | 2007334205 | A | 12/2007 |
| JP | 2008158482 | A | 7/2008 |

OTHER PUBLICATIONS

Abstract of JP 08-262903 published on Oct. 11, 1996.
Abstract of JP 2004-198531 published on Jul. 15, 2004.
Chinese Office Action dated Jun. 28, 2012.

FIXING DEVICE AND IMAGE FORMING APPARATUS INCLUDING SAME

CROSS-REFERENCE TO RELATED APPLICATIONS

This application is a continuation of and claims priority under 35 U.S.C. §§120/121 to U.S. patent application Ser. No. 12/929,325, filed on Jan. 14, 2011, which claims priority pursuant to 35 U.S.C. §119 from Japanese Patent Application No. 2010-013963, filed on Jan. 26, 2010 in the Japan Patent Office. The disclosures of each of the above applications are incorporated herein by reference in their entirety.

BACKGROUND OF THE DISCLOSURE

1. Field of the Disclosure

Exemplary embodiments of the present disclosure relate to an image forming apparatus, such as a copier, a printer, a facsimile machine, or a multi functional device having at least two of the foregoing capabilities, and a fixing device employed in the image forming apparatus.

2. Description of the Background Art

Image forming apparatuses, such as copiers, facsimile machines, printers, or multifunction apparatuses having at least two of copying, printing, scanning, and facsimile capabilities, typically form an image on a recording medium according to image data. In such an image forming apparatus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such a fixing device may include a substantially cylindrical metal member to effectively heat an endless fixing belt serving as a fixing member to shorten a warm-up time or a time to first print (hereinafter also "first print time"). Specifically, the metal member, which is heated by a built-in or external heater, is provided inside a loop formed by the endless fixing belt so as to face the inner circumferential surface of the fixing belt and heat the fixing belt. A pressing roller presses against the outer circumferential surface of the fixing belt at a position corresponding to the location of the metal member inside the loop formed by the fixing belt to form a nip between the fixing belt and the pressing roller through which the recording medium bearing the toner image passes. As the recording medium bearing the toner image passes through the nip, the fixing belt and the pressing roller apply heat and pressure to the recording medium to fix the toner image on the recording medium.

Further, JP-2008-158482-A proposes a fixing device including a stationary member (a first opposing member) against which the pressing roller is pressed via the fixing belt to form a nip and a reinforcement member to reinforce the stationary member.

For example, for a fixing device like that described in JP-2008-158482-A, as the thickness of the metal member is reduced to shorten the warm-up time, the metal member is apt to be thermally deformed during heating. Whether such thermal deformation occurs in a limited area or over a relatively large area of the metal member, it affects the size of a clearance between the fixing belt and the metal member. Consequently, the fixing belt may be unevenly or insufficiently heated, causing uneven or faulty fixing of an output image. In particular, in a case in which the stationary member is pressed against the pressing roller via the fixing belt to form the nip and the metal member is disposed to heat the fixing belt at an area other than the nip, heat of the metal member is easy to disperse at an area close to the nip and difficult to disperse at an area away from the nip. Consequently, the metal member is likely to partially deform, causing a non-negligible failure.

SUMMARY

In an aspect of this disclosure, there is provided an improved fixing device including an endless, flexible fixing member, a pressing member, a stationary member, a substantially cylindrical metal member, flanges, a first heater, and a second heater. The fixing member is rotatably provided in the fixing device to heat a toner image thereon. The pressing member is rotatably pressed against an outer circumferential surface of the fixing member to form a nip between the pressing member and the fixing member. The stationary member is fixedly disposed at an inner circumferential surface side of the fixing member and pressed by the pressing member with the fixing member interposed between the stationary member and the pressing member. The substantially cylindrical metal member is fixedly disposed opposite an inner circumferential surface of the fixing member over an area other than the nip to heat the fixing member. The flanges are disposed at axial edges of the metal member in contact with an inner circumferential surface of the metal member to support the metal member. The first heater is disposed opposite the inner circumferential surface of the metal member to heat an axial middle portion of the metal member. The second heater is disposed opposite the inner circumferential surface of the metal member to heat axial end portions of the metal member. The first heater is disposed farther from the nip than the second heater.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
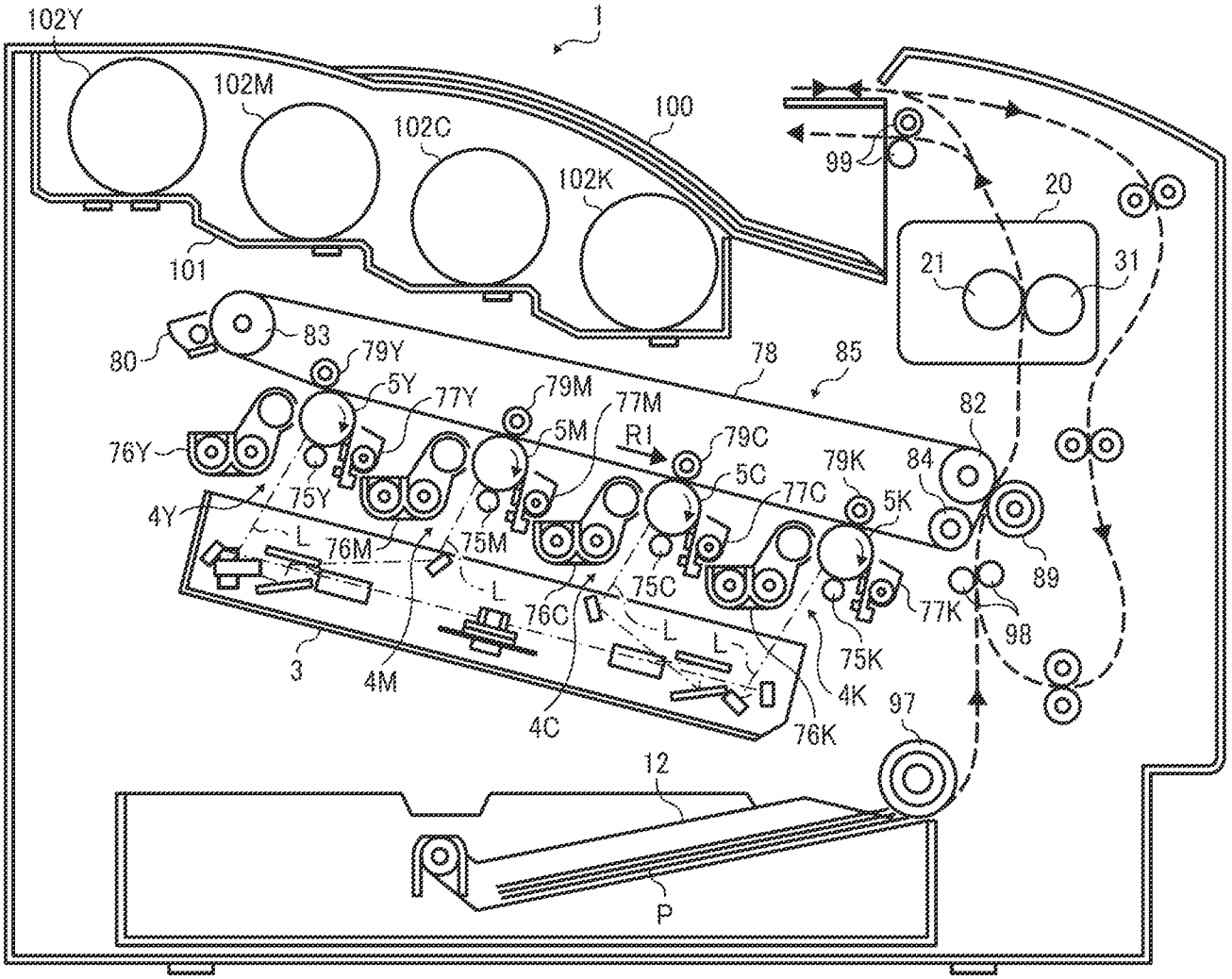
FIG. 1 is a schematic configuration view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, in particular to FIG. 1, an image forming apparatus 1 according to an exemplary embodiment of the present disclosure is described.

First, configuration and operation of the image forming apparatus 1 are described with reference to FIG. 1. As illustrated in FIG. 1, the image forming apparatus 1 may be a copier, a facsimile machine, a printer, a multifunction printer having at least two of copying, printing, scanning, plotting, and facsimile functions, or the like. According to this exemplary embodiment of the present disclosure, the image forming apparatus 1 is a tandem color printer for forming a color image on a recording medium. However, it is to be noted that the image forming apparatus is not limited to the tandem color printer and may be any other suitable type of image forming apparatus.

A toner bottle holder 101 is provided in an upper portion of the image forming apparatus 1. Four toner bottles 102Y, 102M, 102C, and 102K contain yellow, magenta, cyan, and black toners, respectively, and are detachably attached to the toner bottle holder 101 in such a manner that the toner bottles 102Y, 102M, 102C, and 102K are replaceable with new ones, respectively. An intermediate transfer unit 85 is provided below the toner bottle holder 101. Image forming devices 4Y, 4M, 4C, and 4K are arranged opposite an intermediate transfer belt 78 of an intermediate transfer unit 85, and form yellow, magenta, cyan, and black toner images, respectively.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively. In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively. In the exposure process, an exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K are disposed opposite the photoconductive drums 5Y, 5M, 5C, and 5K, respectively. In the transfer process, first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively. Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78. The intermediate transfer unit 85 includes an intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (for example, rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed on the intermediate transfer belt 78 reaches a second transfer nip. At the second transfer nip, the second transfer roller 89 and the second transfer backup roller 82 sandwich the intermediate transfer belt 78. The second transfer roller 89 transfers the color toner image formed on the intermediate transfer belt 78 onto a recording medium P fed by a registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78. Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

In this regard, the recording medium P is fed from a paper tray 12 to the second transfer nip via a feed roller 97 and the registration roller pair 98. Specifically, the paper tray 12 is provided in a lower portion of the image forming apparatus 1, and loads a plurality of recording media P (for example, transfer sheets). The feed roller 97 rotates counterclockwise in FIG. 1 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing belt 21 and a pressing roller 31 apply heat and pressure to the recording medium P to fix the color toner image on the recording medium P. An output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

Figure 2:
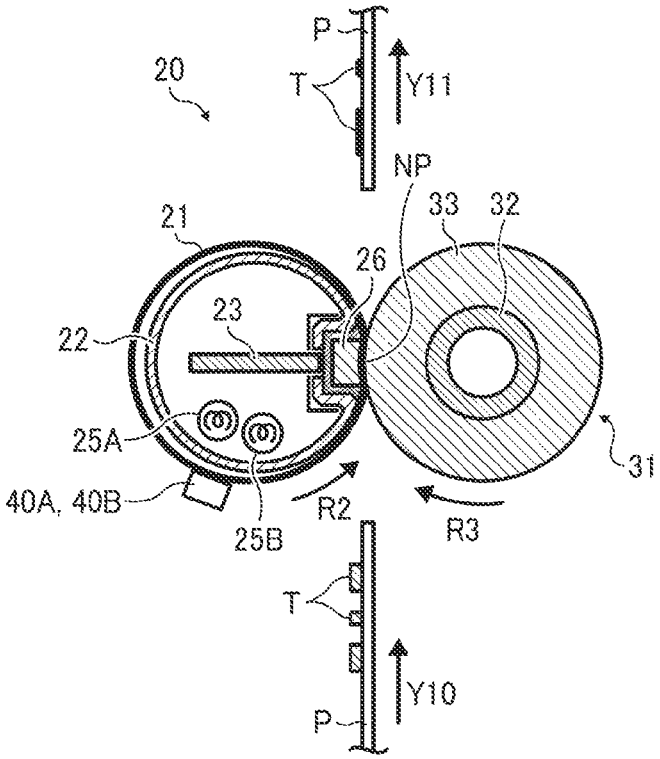
FIG. 2 is a schematic configuration view of a fixing device mounted in the image forming apparatus illustrated in FIG. 1.
Figure 3:
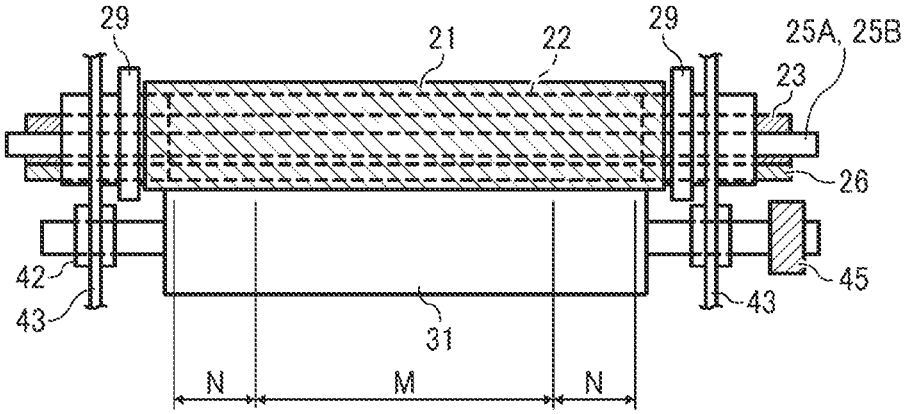
FIG. 3 is a schematic configuration view of the fixing device seen along its axial direction in FIG. 2.
Figure 4:
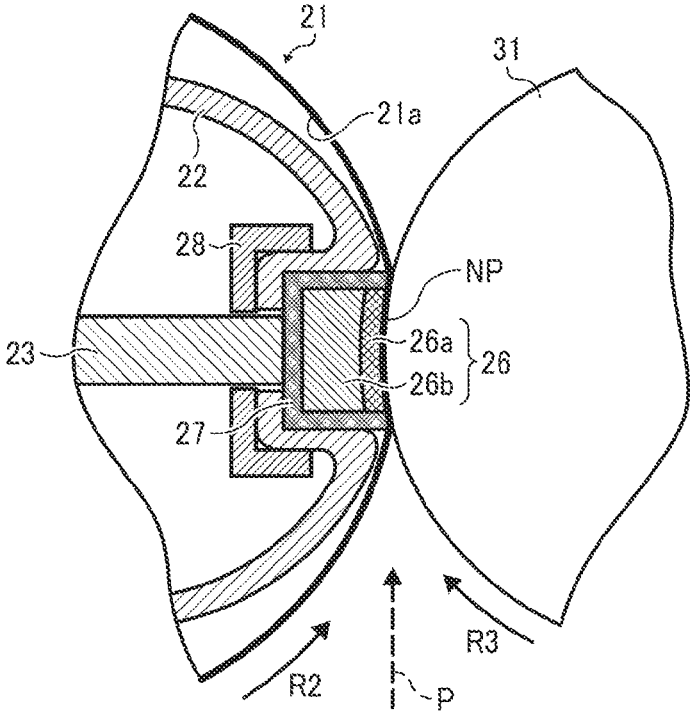
FIG. 4 is an enlarged view of a nip and surrounding structure in the fixing device.

Referring to FIGS. 2 to 7, the following describes the configuration and operation of the fixing device 20. As illustrated in FIGS. 2 to 4, the fixing device 20 includes the fixing belt 21 serving as a fixing member or a belt member, a stationary member 26, a metal member 22 serving as a heating member, a reinforcement member 23, first and second heaters 25A and 25B serving as heat sources, the pressing roller 31 serving as a rotary pressing member, flange members 29, first and second temperature sensors 40A and 40B, a heat insulation member 27, and stays 28.

The fixing belt 21 serving as a fixing member may be a thin, flexible endless belt that rotates or moves counterclockwise in FIG. 2 in a rotation direction R2. The fixing belt 21 includes a base layer, an elastic layer, and a surface release layer that are laminated in this order on an inner circumferential surface 21*a* serving as a sliding surface which slides over the stationary member 26, and has a total thickness not greater than about 1 mm. The base layer of the fixing belt 21 has a thickness in a range of from about 30 μm to about 50 μm, and includes a metal material such as nickel and/or stainless steel, and/or a resin material such as polyimide. The elastic layer of the fixing belt 21 has a thickness in a range of from about 100 μm to about 300 μm, and includes a rubber material such as silicon rubber, silicon rubber foam, and/or fluorocarbon rubber. The elastic layer eliminates or reduces slight surface asperities of the fixing belt 21 at a nip NP formed between the fixing belt 21 and the pressing roller 31. Accordingly, heat is uniformly transmitted from the fixing belt 21 to a toner image T on a recording medium P, thus preventing formation of a faulty image such as a rough surface image. The release layer of the fixing belt 21 has a thickness in a range of from about 10 μm to about 50 μm, and includes, for example, tetrafluoroethylene-perfluoroalkyl-vinyl-ether copolymer (PFA), polytetrafluoroethylene (PTFE), polyimide, polyetherimide, and/or polyether sulfide (PES). The release layer releases or separates the toner image T from the fixing belt 21.

The fixing belt 21 has a loop diameter in a range of from about 15 mm to about 120 mm. According to this exemplary embodiment, the fixing belt 21 has an inner diameter of about 30 mm. As illustrated in FIGS. 2 and 4, the stationary member 26, the first and second heaters 25A and 25B, the metal member 22, the reinforcement member 23, the heat insulation member 27, and the stays 28 are fixedly provided inside a loop formed by the fixing belt 21. In other words, the stationary member 26, the first and second heaters 25A and 25B, the metal member 22, the reinforcement member 23, the heat insulation member 27, and the stays 28 do not face an outer circumferential surface of the fixing belt 21, but face the inner circumferential surface 21*a* of the fixing belt 21. The stationary member 26 is fixed inside the fixing belt 21 in such a manner that the inner circumferential surface 21*a* of the fixing belt 21 slides over the stationary member 26. The stationary member 26 is pressed by the pressing roller 31 via the fixing belt 21 to form the nip NP between the fixing belt 21 and the pressing roller 31 through which the recording medium P is transported. As illustrated in FIG. 3, both ends of the stationary member 26 in a width direction of the stationary member 26 parallel to an axial direction of the fixing belt 21 are mounted on and supported by side plates 43 of the fixing device 20, respectively. The configuration of the stationary member 26 is described in more detail below.

As illustrated in FIG. 2, the metal member 22 has a substantially pipe (cylindrical) shape. The metal member 22 serving as a heating member directly faces the inner circumferential surface 21*a* of the fixing belt 21 over an area other than the nip NP. At the nip NP, the metal member 22 holds the stationary member 26 via the heat insulation member 27. As illustrated in FIG. 3, both ends of the metal member 22 in a width direction of the metal member 22 parallel to the axial direction of the fixing belt 21 are fixed on and supported by the side plates 43 of the fixing device 20 via flanges 29. The flanges 29 are provided on the ends of the metal member 22 in the width direction of the metal member 22 to restrict movement (for example, shifting) of the fixing belt 21 in the axial direction of the fixing belt 21. The configuration of the flanges 29 is described in more detail below.

The metal member 22 heated by radiation heat generated by the first and second heaters 25A and 25B heats (for example, transmits heat to) the fixing belt 25B. In other words, the first and second heaters 25A and 25B heat the metal member 22 directly and heat the fixing belt 21 indirectly via the metal member 22. The metal member 22 may have a thickness not greater than about 0.1 mm to maintain desired heating efficiency for heating the fixing belt 21. The metal member 22 may include a metal heat conductor, that is, a metal having a heat conductivity, such as stainless steel, nickel, aluminum, and/or iron. Preferably, the metal member 22 may include ferrite stainless steel having a relatively smaller heat capacity per unit volume obtained by multiplying density by specific heat. According to this exemplary embodiment, the metal member 22 includes SUS430 stainless steel as ferrite stainless steel, and has a thickness of about 0.1 mm.

The first heater 25A and the second heater 25B may be a halogen heater and/or a carbon heater. As illustrated in FIG. 3, both ends of each of the first heater 25A and the second heater 25B in the width direction of the heaters 25A and 25B parallel to the axial direction of the fixing belt 21 are fixedly mounted on the side plates 43 of the fixing device 20. Radiation heat generated by the first and second heaters 25A and 25B, which is controlled by a power source provided in the image forming apparatus 1 depicted in FIG. 1, heats the metal member 22. The metal member 22 heats substantially the entire fixing belt 21. In other words, the metal member 22 heats the fixing belt 21 over an area other than the nip NP. Heat is transmitted from the heated outer circumferential surface of the fixing belt 21 to the toner image T on the recording medium P. As illustrated in FIG. 3, the outputs of the first and second heaters 25A and 25B are controlled according to detection results of the surface temperature of the fixing belt 21 by the first and second temperature sensors 40A and 40B such as thermistors. Through the output control of the first and second heaters 25A and 25B, the temperature (for example, fixing temperature) of the fixing belt 21 is adjusted to a desired temperature. The first temperature sensor 40A is provided to detect the surface temperature (fixing temperature) of a middle portion of the fixing belt 21 in the width direction of the fixing belt 21, and the second temperature sensor 40B is provided to detect the surface temperature (fixing temperature) of an end portion of the fixing belt 21 in the width direction of the fixing belt 21. In this exemplary embodiment, the first heater 25A is provided to heat a middle portion of the metal member 22 in the width direction of the metal member 22, and the second heater 25B is provided to heat end portions of the metal member 22 in the width direction of the metal member 22. The first and second heaters 25A and 25B are disposed to face the inner circumferential surface of the metal member 22. The first heater 25A is disposed farther from the nip NP than the second heater 25B. The configuration of the first and second heaters 25A and 25B is described in more detail below.

As described above, in the fixing device 20 according to this exemplary embodiment, the metal member 22 does not heat a very limited portion of the fixing belt 21 but heats substantially the entire fixing belt 21 in a circumferential direction of the fixing belt 21. Accordingly, even when the image forming apparatus 1 depicted in FIG. 1 forms a toner image at high speed, the fixing belt 21 is heated enough to suppress fixing failure. In other words, the relatively simple structure of the fixing device 20 heats the fixing belt 21 efficiently, resulting in a shortened warm-up time, a shortened first print time, and the downsized image forming apparatus 1.

As illustrated in FIGS. 2 and 4, the metal member 22 is disposed opposite the fixing belt 21 in such a manner that a certain clearance 6 is provided between the inner circumferential surface 21*a* of the fixing belt 21 and the metal member 22 all along the inner surface of the fixing belt 21 except for where the nip NP is formed. The clearance 6, that is, a gap between the fixing belt 21 and the metal member 22 at all points along the inner surface of the fixing belt 21 other than the nip NP, is not greater than 1 mm, expressed as $0\ \text{mm} < \delta = < 1\ \text{mm}$. Accordingly, the fixing belt 21 does not slidably contact the metal member 22 over an increased area, thus suppressing wear of the fixing belt 21. At the same time, the clearance between the metal member 22 and the fixing belt 21 is small enough to prevent any substantial decrease in heating efficiency of the metal member 22 for heating the fixing belt 21. Moreover, the metal member 22 disposed close to the fixing belt 21 supports the fixing belt 21 and maintains the circular loop form of the flexible fixing belt 21, thus limiting degradation of and damage to the fixing belt 21 due to deformation of the fixing belt 21. A lubricant, such as fluorine grease, is applied between the inner circumferential surface 21*a* of the fixing belt 21 and the metal member 22, so as to reduce wear of the fixing belt 21 as the fixing belt 21 slidably contacts the metal member 22. According to this exemplary embodiment, the metal member 22 has a substantially circular shape in cross-section. Alternatively, the metal member 22 may have a polygonal shape in cross-section or may include a slit along a circumferential surface thereof.

As illustrated in FIG. 2, the reinforcement member 23 reinforces the stationary member 26 which forms the nip NP between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, a length (width) of the reinforcement member 23 in a width direction of the reinforcement member 23 parallel to the axial direction of the fixing belt 21 is equivalent to a length (width) of the stationary member 26 in the width direction of the stationary member 26 parallel to the axial direction of the fixing belt 21. Both ends of the reinforcement member 23 in the width direction of the reinforcement member 23 are fixedly mounted on the side plates 43 of the fixing device 20 in such a manner that the side plates 43 support the reinforcement member 23. As illustrated in FIG. 2, the reinforcement member 23 is pressed against the pressing roller 31 via the stationary member 26 and the fixing belt 21. Thus, the stationary member 26 is not deformed substantially when the stationary member 26 receives pressure applied by the pressing roller 31 at the nip NP. In this exemplary embodiment, the reinforcement member 23 is a plate member disposed so as to divide the interior of the metal member 2 into substantially two spaces.

In order to provide the above-described capabilities, the reinforcement member 23 preferably includes a metal material having great mechanical strength, such as stainless steel and/or iron. An opposing surface of the reinforcement member 23 which faces the heaters 25 may be partially or wholly covered with a heat insulation material. Alternatively, the opposing surface of the reinforcement member 23 disposed opposite the heater 25 may be mirror-ground. Accordingly, heat output by the heaters 25 toward the reinforcement member 23 to heat the reinforcement member 23 is used to heat the metal member 22, improving heating efficiency for heating the metal member 22 and the fixing belt 21.

As illustrated in FIG. 2, the pressing roller 31 serves as a rotary pressing member for contacting and pressing against the outer circumferential surface of the fixing belt 21 at the nip NP. The pressing roller 31 has a loop diameter of about 30 mm. In the pressing roller 31, an elastic layer 33 is provided on a hollow metal core 32. The elastic layer 33 may be silicon rubber foam, silicon rubber, and/or fluorocarbon rubber. A thin release layer including PFA and/or PTFE may be provided on the elastic layer 33 to serve as a surface layer. The pressing roller 31 is pressed against the fixing belt 21 to form the desired nip NP between the pressing roller 31 and the fixing belt 21. As illustrated in FIG. 3, a gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatively supported by the side plates 43 of the fixing device 20 via bearings 42, respectively. A heat source, such as a halogen heater, may be provided inside the pressing roller 31, but is not necessary.

In a case in which the elastic layer 33 of the pressing roller 31 includes a sponge material such as silicon rubber foam, the pressing roller 31 applies decreased pressure to the fixing belt 21 at the nip NP to reduce bending of the metal member 22. Further, the pressing roller 31 provides increased heat insulation, and therefore heat transmission from the fixing belt 21 to the pressing roller 31 is prevented, thus improving heating efficiency for heating the fixing belt 21. In FIG. 4, the loop diameter of the fixing belt 21 is substantially equivalent to the loop diameter of the pressing roller 31. Alternatively, the loop diameter of the fixing belt 21 may be smaller than the loop diameter of the pressing roller 31. In this case, a curvature of the fixing belt 21 is smaller than a curvature of the pressing roller 31 at the nip NP, and therefore a recording medium P easily separates from the fixing belt 21 when the recording medium P is discharged from the nip NP.

As illustrated in FIG. 4, the inner circumferential surface 21*a* of the fixing belt 21 slides over the stationary member 26. In the stationary member 26, a surface layer 26*a* is provided on a base layer 26*b* and has an opposing surface (for example, a sliding surface) of the stationary member 26 that faces the pressing roller 31. The surface layer 26*a* is formed in a concave shape so that the opposing surface has a curvature corresponding to a curvature of the pressing roller 31. The recording medium P moves along the concave, opposing surface of the stationary member 26 corresponding to the curvature of the pressing roller 31, and is discharged from the nip NP. The concave shape facilitates separation of the recording medium P bearing the fixed toner image T from the fixing belt 21. According to this exemplary embodiment, the stationary member 26 has a concave shape to form the concave nip NP. Alternatively, the stationary member 26 may have a flat, planar shape to form a planar nip NP. Specifically, the sliding surface of the stationary member 26 which faces the pressing roller 31 may have a flat, planar shape. Accordingly, the planar nip NP formed by the planar sliding surface of the stationary member 26 is substantially parallel to an image side of the recording medium P. Consequently, the fixing belt 21 pressed by the planar sliding surface of the stationary member 26 is adhered to the recording medium P precisely to improve fixing properties. Further, the increased curvature of the fixing belt 21 at an exit of the nip NP facilitates separation of the recording medium P discharged from the nip NP from the fixing belt 21.

The base layer 26*b* of the stationary member 26 includes a rigid material (for example, a highly rigid metal or ceramic) so that the stationary member 26 is not bent substantially by pressure applied by the pressing roller 31. The substantially cylindrical metal member 22 may be formed by bending sheet metal into the desired shape. Sheet metal is used to give the metal member 22 a thin thickness to shorten warm-up time. However, such a thin metal member 22 has little rigidity, and therefore is easily bent or deformed by pressure applied by the pressing roller 31. If the metal member 22 is deformed, a desired nip length of the nip NP may not be obtained, degrading fixing properties. To cope with such a potential problem, according to this exemplary embodiment, the rigid stationary member 26 is provided separately from the thin metal member 22 to help form and maintain the proper nip NP.

As illustrated in FIG. 4, the heat insulation member 27 is provided between the stationary member 26 and the heaters 25A and 25B. Specifically, the heat insulation member 27 is provided between the stationary member 26 and the metal member 22 in such a manner that the heat insulation member 27 covers surfaces of the stationary member 26 other than the sliding surface of the stationary member 26 over which the fixing belt 21 slides. The heat insulation member 27 includes sponge rubber having desired heat insulation performance and/or ceramic including air pockets. The metal member 22 is disposed close to the fixing belt 21 throughout substantially the entire circumference thereof. Accordingly, even in a standby mode before printing starts, the metal member 22 heats the fixing belt 21 in the circumferential direction without temperature fluctuation. Consequently, the image forming apparatus 1 starts printing as soon as the image forming apparatus 1 receives a print request. In a conventional on-demand fixing device like that described in JP-2884714-B2, when heat is applied to a deformed pressing roller at a nip in a standby mode, the pressing roller may suffer from thermal degradation due to heating of the rubber included in the pressing roller, resulting in a shortened life of the pressing roller or permanent compression strain of the pressing roller. Further, heat applied to the deformed rubber increases permanent compression strain of the rubber. The permanent compression strain of the pressing roller makes a dent in a part of the pressing roller, and therefore the pressing roller does not provide a desired nip length of the nip, causing faulty fixing or noise in accordance with rotation of the pressing roller. To cope with such failures, according to this exemplary embodiment, the heat insulation member 27 is provided between the stationary member 26 and the metal member 22 to reduce heat transmitted from the metal member 22 to the stationary member 26 in the standby mode, thus preventing the pressing roller 31 from being heated at high temperature in the standby mode with the pressing roller 31 being deformed.

A lubricant is applied between the stationary member 26 and the fixing belt 21 to reduce sliding resistance between the stationary member 26 and the fixing belt 21. However, the lubricant may deteriorate under high pressure and temperature applied at the nip NP, causing unstable slippage of the fixing belt 21 over the stationary member 26. To cope with this failure, according to this exemplary embodiment, the heat insulation member 27 is provided between the stationary member 26 and the metal member 22 to reduce heat transmitted from the metal member 22 to the lubricant at the nip NP, thus reducing deterioration of the lubricant due to high temperature.

The heat insulation member 27 provided between the stationary member 26 and the metal member 22 insulates the stationary member 26 from the metal member 22. Accordingly, the metal member 22 heats the fixing belt 21 with reduced heat at the nip NP. Consequently, the recording medium P discharged from the nip NP has a decreased temperature compared to when the recording medium P enters the nip NP. In other words, at the exit of the nip NP, the fixed toner image T on the recording medium P has a decreased temperature, and therefore the toner of the fixed toner image T has a decreased viscosity. Accordingly, an adhesive force which adheres the fixed toner image T to the fixing belt 21 is reduced and the recording medium P is separated from the fixing belt 21. Consequently, the recording medium P is not wound around the fixing belt 21 immediately after the fixing process, preventing or reducing jamming of the recording medium P and firm adhesion of the toner of the toner image T to the fixing belt 21.

As illustrated in FIG. 4, the stays 28 contact an inner circumferential surface of a recessed portion of the metal member 22 into which the stationary member 26 is inserted so as to hold the metal member 22. In the present embodiment, a stainless steel sheet having a thickness of about 0.1 mm is bent into the substantially-cylindrical metal member 22. However, spring-back of the stainless steel sheet may expand the circumference of the metal member 22, and therefore the stainless steel sheet may maintain the desired pipe shape. Consequently, the metal member 22 having an expanded circumference may contact the inner circumferential surface of the fixing belt 21, thus damaging the fixing belt 21 or generating temperature fluctuation of the fixing belt 21 due to uneven contact of the metal member 22 to the fixing belt 21. To cope with such a failure, according to this exemplary embodiment, the stays 28 support and hold the recessed portion (for example, a bent portion) of the metal member 22 provided with an opening so as to prevent deformation of the metal member 22 due to spring-back. For example, the stays 28 are press-fitted to the recessed portion of the metal member 22 to contact the inner circumferential surface of the metal member 22 while the shape of the metal member 22 that is bent against spring-back of the stainless steel sheet is maintained.

Preferably, the metal member 22 has a thickness not greater than about 0.2 mm to increase heating efficiency of the metal member 22. The substantially cylindrical metal member 22 may be formed by bending sheet metal into the desired shape. Sheet metal is used to give the metal member 22 a thin thickness to shorten warm-up time. However, the thin metal member 22 may have a low rigidity, and therefore may be easily bent or deformed by pressure applied by the pressing roller 31. Consequently, the deformed metal member 22 may not provide a desired nip length of the nip NP, resulting in degraded fixing properties. Hence, according to this exemplary embodiment, the recessed portion of the thin metal member 22 into which the stationary member 26 is inserted is spaced away from the nip NP to prevent the metal member 22 from receiving pressure directly from the pressing roller 31.

Referring to FIG. 2, the following describes operation of the fixing device 20 having the above-described structure. When the image forming apparatus 1 is powered on, power is supplied from a power source to the heaters 25A and 25B, and the pressing roller 31 starts rotating in the rotation direction R3. Friction between the pressing roller 31 and the fixing belt 21 rotates the fixing belt 21 in the rotation direction R2. Thereafter, a recording medium P is sent from the paper tray 12 to the second transfer nip formed between the intermediate transfer belt 78 and the second transfer roller 89. At the second transfer nip, a color toner image is transferred from the intermediate transfer belt 78 onto the recording medium P. A guide plate guides the recording medium P bearing the toner image T in a direction Y10 of FIG. 2 so that the recording medium P enters the nip NP formed between the fixing belt 21 and the pressing roller 31 pressed against each other. At the nip NP, the fixing belt 21 heated by the heaters 25A and 25B via the metal member 22 applies heat to the recording medium P. Simultaneously, the pressing roller 31 and the stationary member 26 reinforced by the reinforcement member 23 apply pressure to the recording medium P. Thus, the heat applied by the fixing belt 21 and the pressure applied by the pressing roller 31 fix the toner image T on the recording medium P. Thereafter, the recording medium P bearing the fixed toner image T discharged from the nip NP is conveyed in a direction Y11 illustrated in FIG. 2.

Figure 7:
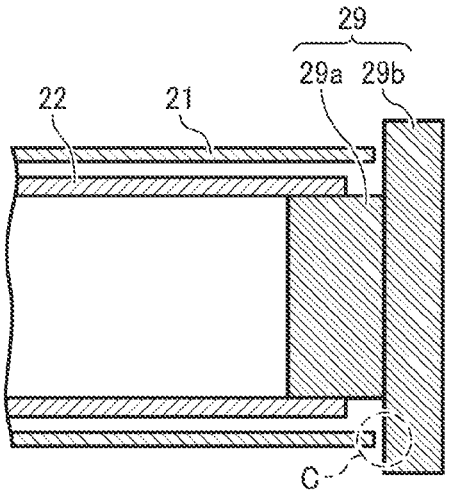
FIG. 7 is an enlarged view of a flange and surrounding structure seen along the axial direction of the fixing belt.

The following describes the structure and operation of the fixing device 20 in detail. As illustrated in FIGS. 3 and 7, the fixing device 20 according to the first exemplary embodiment includes the flanges 29 that contact the inner circumferential surface of the metal member 22 at end portions of the metal member 22 in a width direction, i.e., the axial direction of the metal member 22 to reinforce the metal member 22. Specifically, each of the flanges 29 is made of the same material (for example, SUS430) as the material of the metal member 22 and has a cylindrical reinforcement portion 29*a* of reduced outer diameter compared to a cylindrical stopper portion (bottom portion) 29*b*. The reinforcement portion 29*a* of each flange 29 is inserted into the metal member 22 to contact an inner circumferential face of an end portion of the metal member 22 with only slight pressure. As illustrated in FIG. 7, the outer diameter of the stopper portion 29*b* of each flange 29 is greater than the outer diameter of the fixing belt 21. The axial length of the fixing belt 21 (for example, in the lateral direction in FIG. 3) is greater than the axial length of the metal member 22. In other words, the axial range of the fixing belt 21 includes the axial range of the metal member 22. The stopper portion 29*b* and the fixing belt 21 (or the metal member 22) are arranged to form a clearance of approximately a few millimeters therebetween. In the first exemplary embodiment, end portions of the metal member 22 are supported by the flanges 29 (in particular, the reinforcement portion 29*a*), thus suppressing thermal deformation of the relatively thin metal member. Such a configuration can suppress thermal deformation of, in particular, the axial end portions of the metal member 22 reinforced directly by the flanges 29 as compared to an axial middle portion of the metal member 22.

Figure 5:
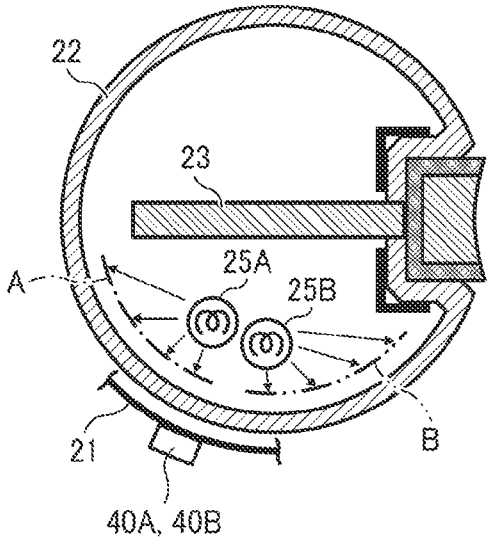
FIG. 5 is an enlarged view of flux distribution of a first heater and a second heater disposed inside a metal member.
Figure 6A:
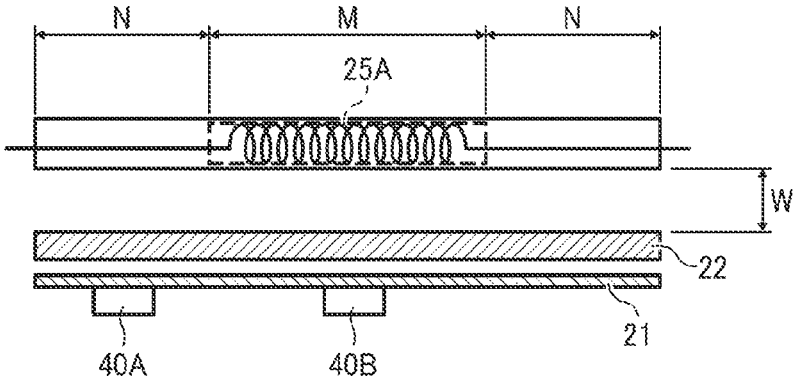
FIG. 6A is a schematic view of the first heater seen along its axial direction.
Figure 6B:
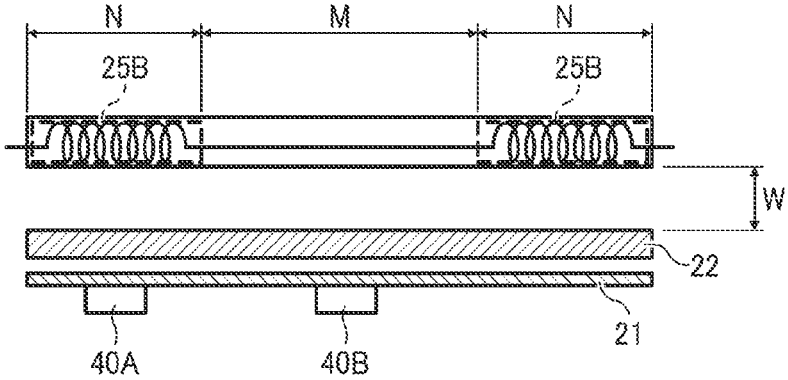
FIG. 6B is a schematic view of the second heater seen along its axial direction.

As illustrated in FIGS. 2, 5, and 6A and 6B, in the fixing device 20 according to the present exemplary embodiment, two heaters (the first heater 25A and the second heater 25B) serving as heating members are disposed opposite the inner circumferential surface of the metal member 22. The first heater 25A is disposed opposite an axial middle portion M of the inner circumferential surface of the metal member 22 to heat the axial middle portion M. By contrast, the second heater 25B is disposed opposite axial end portions N of the metal member 22 to heat the axial end portions N. The first heater 25A and the second heater 25B are arranged along the inner circumferential surface of the metal member 22 to face the inner circumferential surface of the metal member 22. The first heater 25A is disposed relatively far from the nip NP and the second heater 25B is disposed relatively close to the nip NP. The flux distribution of the heaters is illustrated by arrows in FIG. 5. As illustrated in FIG. 5, the flux distribution of the second heater 25B is adjusted so as to cover mainly an area B of the inner circumferential surface of the metal member 22 relatively close to the nip NP. By contrast, the flux distribution of the first heater 25A is adjusted so as to cover mainly an area A of the inner circumferential surface of the metal member 22 relatively far from the nip NP. The adjustment of the flux distribution of the first and second heaters 25A and 25B can be achieved by, for example, mirror-finishing or shielding a portion of a glass tube of each heater.

For such a configuration, as the axial end portions N of the metal member 22 are heated by the second heater 25B at a position relatively close to the nip NP, thermal diffusion may be suppressed, which is a disadvantage with respect to the thermal deformation. However, as described above, the flanges 29 (the reinforcement portion 29*a*) directly reinforce the axial end portions N of the metal member 22 to offset the disadvantage, thus preventing the thermal deformation described above.

The axial middle portion M of the metal member 22 is not directly reinforced by the flanges 29 (the reinforcement portion 29*a*), which might be a disadvantage with respect to the thermal deformation. However, as described above, the first heater 25A is disposed relatively far from the nip NP to heat the axial middle portion M of the metal member 22 so as to offset the disadvantage, thus preventing the thermal deformation described above. Thus, the above-described configuration can suppress partial deformation of the metal member 22 over the entire metal member 22, thus preventing the amount of the clearance between the fixing belt 21 and the metal member 22 from fluctuating locally or over the entire length of the fixing belt 21 and the metal member 22. Accordingly, uneven or faulty heating of the fixing belt 21 can be prevented, thereby reducing uneven image fixing or other failures.

Moreover, at the axial end portions N of the metal member 22 into which the flanges 29 are inserted, heat of the metal member 22 might be transferred to the flanges 29 to reduce the heating efficiency of the axial end portions N as compared to the axial middle portion M of the metal member 22. Hence, in the present exemplary embodiment, the second heater 25B is disposed close to the nip NP to heat the axial end portions N of the metal member 22 and the first heater 25A is disposed far from the nip NP to heat the axial middle portion M of the metal member 22. For such a configuration, the heating efficiency of the metal member 22 is obtained in a balanced manner in the axial direction of the metal member 22, preventing the fixing belt 21 from being unevenly heated in the axial direction of the fixing belt 21. The reinforcement portion 29*a* of the flanges 29 is preferably dimensioned in the axial direction so as to optimize the balance between the above-described disadvantage of the reduction in heating efficiency and the advantage of the reinforcement of the metal member 22.

The turning on and off of the heaters 25A and 25B is controlled in accordance with detection results of a first temperature sensor 40A that detects the temperature of an axial middle portion of the fixing belt 21 and a second temperature sensor 40B that detects the temperature of axial end portions of the fixing belt 21. The first heater 25A and the second heater 25B are separately controlled so that each of the first temperature sensor 40A and the second temperature sensor 40B detects a desired temperature (the fixing temperature).

As illustrated in FIG. 6, in the present exemplary embodiment, the distance W between the first heater 25A and the inner circumferential surface of the metal member 22 is equal to the distance W between the second heater 25B and the inner circumferential surface of the metal member 22. Specifically, the first heater 25A and the second heater 25B are concentrically arranged with respect to the inner circumferential surface of the metal member 22. Such a configuration facilitates temperature control of the axial middle portion of the metal member 22 heated by the first heater 25A and the axial end portions of the metal member 22 heated by the second heater 25B.

Figure 8A:
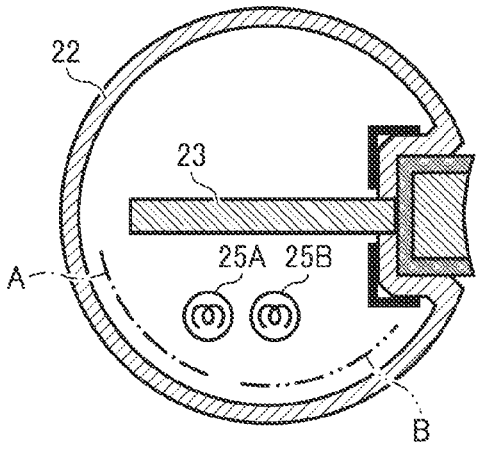
FIG. 8A is a schematic view showing an arrangement of the first heater and the second heater inside the metal member.
Figure 8B:
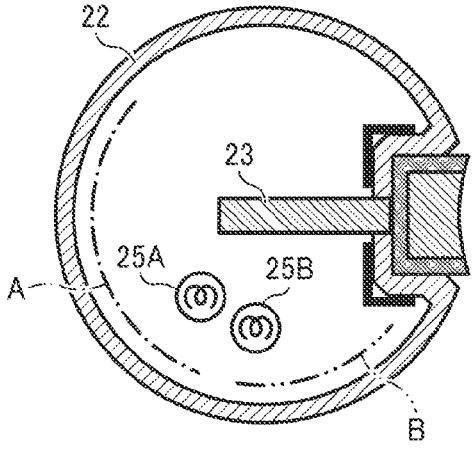
FIG. 8B is a schematic view showing another arrangement of the first heater and the second heater inside the metal member.

Alternatively, as illustrated in FIG. 8A, the distance between the first heater 25A and the inner circumferential surface of the metal member 22 may be different from the distance between the second heater 25B and the inner circumferential surface of the metal member 22. In addition, as illustrated in FIG. 8B, the shape of the reinforcement member 23 may be varied so as to increase and decrease a heated area A at which the metal member 22 is heated by the first heater 25A.

The heat value of the first heater 25A per unit area is preferably equivalent to or less than the heat value of the second heater 25B per unit area. The output ratings of the first heater 25A and the second heater 25B may be, for example, 640 W and 800 W, respectively. Such a configuration can increase tolerance in both thermal deformation of the axial middle portion M of the metal member 22 caused by heating of the first heater 25A and reduction of heating efficiency caused by heat transfer from the metal member 22 to the flanges 29. It is to be noted that the heat value of each heater per unit area is determined not only by the output rating but also by the duties of turning on-and-off of each heater. Specifically, in a case in which heaters having the same output rating are used, one heater having a higher average turning-on rate per unit time has a greater heat value per unit area. Further, comparing a case in which a heater having an output rating of 800 W is used at the average turning-on rate of 80% with a case in which a heater having an output rating of 640 W is used at the average turning-on rate of 100%, both heaters have the same total heating amount. However, the former has a larger instantaneous heating value, which is disadvantageous in thermal deformation of the metal member 22.

As illustrated in FIGS. 2 and 5, in the present exemplary embodiment, the reinforcement member 23 is disposed so as to divide the inside of the metal member 22 into substantially two spaces. Of the substantially two spaces into which the interior of the metal member 22 is divided by the reinforcement member 23, both the first heater 25A and the second heater 25B are disposed in the upstream space upstream of the nip in the rotation direction R2 of the fixing belt 21. During rotation, the fixing belt 21 is more tensed at the upstream side of the nip than the downstream side thereof. As a result, the clearance between the fixing belt 21 and the metal member 22 at the upstream side of the nip may be smaller than at the downstream side of the nip. Thus, since heat of the metal member 22 is more efficiently transmitted to the fixing belt 21, both the first heater 25A and the second heated 25B are disposed in the space at the upstream side of the nip. Such a configuration can suppress temperature decrease of the surface of the fixing belt 21 that may be caused while the surface of the fixing belt 21 is in the process of reaching the nip, thus facilitating control of the fixing temperature.

In the present exemplary embodiment, the flanges 29 are made of the same material as the material of the metal member 22. Thus, the coefficient of thermal expansion of the flanges 29 is to the same as that of the metal member 22, reducing or eliminating any weakening of the flanges 29 that may be caused by the difference in the coefficient of thermal expansion during heating, deformation or damage of the flanges 29 and/or the metal member 22 that may be caused by abutting of the flanges 29 against the metal member 22, or other failure.

In the present exemplary embodiment, the flanges 29 are mounted on the metal member 22 without adhesion. In this regard, it is to be noted that the term "adhesion" used herein may include joining by, for example, welding or press-fitting, in addition to adhesion by adhesive. Such a configuration prevents the metal member 22 and the flanges 29 from mutual restricting expansion even if the metal member 22 and the flanges 29 thermally expand during heating, thus suppressing deformation of and damage to the metal member 22 and the flanges 29.

Further, in the present exemplary embodiment, each of the flanges 29 has a structure to restrict axial movement of the fixing belt 21 by contacting axial edges of the fixing belt 21. Specifically, as illustrated in FIG. 7, each of the flanges 29 includes the stopper portion 29*b* having an outer diameter greater than an outer diameter of the fixing belt 21. Thus, even if the fixing belt 21 slides axially (for example, in a horizontal direction of FIG. 7) during rotation, an edge of the fixing belt 21 contacts the stopper portion 29*b* at a position indicated by a circle C in FIG. 7, preventing further axial sliding of the fixing belt 21.

Figure 9:
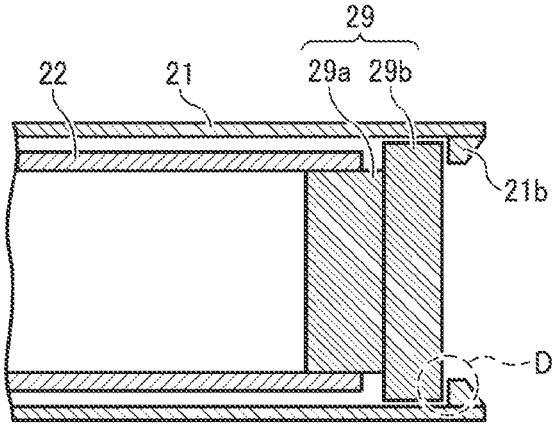
FIG. 9 is an enlarged view of a flange and surrounding structure in a fixing device according to another exemplary embodiment.

As described above, in the present exemplary embodiment, the flanges 29 include the stopper portion 29*b* to restrict axial sliding of the fixing belt 21. Alternatively, as illustrated in FIG. 9, the fixing belt 21 includes slide stoppers 21*b* to restrict axial sliding of the fixing belt 21. Specifically, as illustrated in FIG. 9, the slide stopper 21*b* may be provided on the inner circumferential surface of each end of the fixing belt 21 so as to protrude inward. When the fixing belt 21 slides axially during rotation, the slide stopper 21*b* of the fixing belt 21 contacts the flange 29, for example, at a position indicated by a circle D in FIG. 9, preventing further axial sliding of the fixing belt 21.

As described above, in the present exemplary embodiment, the first heater 25A that heats the axial middle portion of the metal member 22 is disposed relatively far from the nip NP whereas the second heater 25B that heats the axial end portions of the metal member 22 is disposed relatively close to the nip NP. Further, the first heater 25A and the second heater 25B are disposed opposite the inner circumferential surface of the metal member 22 provided with the flanges 29 at the edges of the metal member 22. Such a configuration can reduce warm-up time and first print time and prevent fixing failures such as non-uniform image fixing that might be caused by thermal deformation of the metal member 22.

In the present exemplary embodiment, the fixing belt 21 has a multilayer structure. Alternatively, the fixing belt may be an endless-shaped fixing belt including, for example, polyimide, polyamide, fluorocarbon resin, and/or metal. Such a configuration can achieve effects equivalent to those of the present exemplary embodiment.

In the present exemplary embodiment, the contact-type temperature sensors 40A and 40B are used as temperature detectors. Alternatively, the temperature detectors may be, for example, non-contact-type temperature sensors (thermopiles). Further, the temperature sensors 40A and 40B or non-contact-type temperature sensors may be disposed upstream or downstream of the positions illustrated in FIG. 2 in the rotation direction R2 of the fixing belt 21. Such a configuration can achieve effects equivalent to those of the present exemplary embodiment.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways.

For example, the number, position, and shape of the components are not limited to the above-described exemplary embodiments and may be any other suitable number, position, and shape may be used. Further, elements and/or features of different exemplary embodiments may be combined with each other and/or substituted for each other within the scope of this disclosure and appended claims. Such variations are not to be regarded as a departure from the scope of the present disclosure and appended claims, and all such modifications are intended to be included within the scope of the present disclosure and appended claims.

What is claimed is:

1. A fixing device comprising:

an endless, flexible fixing member rotatably provided in the fixing device to heat a toner image thereon;

a pressing member rotatably pressed against an outer circumferential surface of the fixing member to form a nip between the pressing member and the fixing member;

a stationary member fixedly disposed at an inner circumferential surface side of the fixing member and pressed by the pressing member with the fixing member interposed therebetween;

a reinforcement member pressed by the pressing member via the fixing member and the stationary member;

flanges to restrict movement of the fixing member in a width direction of the fixing member; and a heater unit including a first heater and a second heater disposed at the inner circumferential surface side of the fixing member, the first heater having a main part at a center in an axial direction thereof; the second heater having main parts at ends in an axial direction thereof, wherein the first heater is disposed farther from the nip than the second heater.

2. The fixing device of claim 1, wherein the reinforcement member has a surface opposing the heater unit and at least a portion of the surface is mirror-finished.

3. The fixing device of claim 1, wherein the heater unit is disposed at a position upstream from the nip in a traveling direction of the fixing member.

* * * * *